US005125325A

United States Patent [19]

Czukkermann

[11] Patent Number: 5,125,325

[45] Date of Patent: Jun. 30, 1992

[54] PISTON WITH CUSHIONING SPEAR HAVING EXHAUST PORTS THEREIN

[75] Inventor: John S. Czukkermann, Dunedin, Fla.

[73] Assignee: John Crossno, Decatur, Ala.

[21] Appl. No.: 629,313

[22] Filed: Dec. 18, 1990

[51] Int. Cl.[5] ..... F15B 15/22

[52] U.S. Cl. ..... 92/10; 92/82; 92/85 B; 92/143; 91/407; 91/409

[58] Field of Search ..... 91/405, 407, 408, 409; 92/8, 10, 82, 85 R, 85 B, 143

[56] References Cited

U.S. PATENT DOCUMENTS

| | | | |
|---|---|---|---|
| 2,768,611 | 10/1956 | Anderson | 91/407 X |
| 3,264,942 | 8/1966 | Witt | 92/8 X |
| 3,390,616 | 7/1968 | Hammer | 92/85 B |
| 4,043,787 | 8/1977 | Foster | 91/408 X |
| 4,706,781 | 11/1987 | Ikimi et al. | 91/405 X |
| 4,862,786 | 9/1989 | Boyer et al. | 92/85 B X |
| 4,982,652 | 1/1991 | Blatt | 92/85 B X |

FOREIGN PATENT DOCUMENTS

| | | | |
|---|---|---|---|
| 0287603 | 11/1970 | U.S.S.R. | 92/85 B |
| 0706578 | 12/1979 | U.S.S.R. | 92/85 B |
| 1602914 | 11/1981 | United Kingdom | 92/85 B |

*Primary Examiner*—Edward K. Look
*Assistant Examiner*—John Ryznic
*Attorney, Agent, or Firm*—Joseph C. Mason, Jr.; Ronald E. Smith

[57] ABSTRACT

Cylinders of the type used in fluid power systems are cushioned by a floating spear. The reciprocating piston is centrally bored to receive the spear. Accordingly, the spear and piston are movable independent of each other. A blind axial bore is formed in opposite ends of the spear and one or more diametrically extending bores are also formed in the spear in open fluid communication with those axial bores. Thus, when the spear enters the cushion cavity, the piston continues its motion and progressively blocks off the diametrically extending bores. Air in the cylinder cavity escapes into the atmosphere through the cushion cavity, but is constrained to enter the spear through one or more of the diametrically extending bores and hence through an axially extending blind bore. The length of the spear is variable, as is the length and diameter of the blind bore and the number, diameter, and spacing of the diametrically extending bores. Thus, the deceleration of the piston is programmable.

18 Claims, 5 Drawing Sheets

PISTON WITH CUSHIONING SPEAR HAVING EXHAUST PORTS THEREIN

TECHNICAL FIELD

This invention relates, generally, to fluid power systems that include hydraulic and pneumatic cylinders. More particularly, it relates to an improved cushioning means for such cylinders.

BACKGROUND ART

When a pneumatic or hydraulic cylinder is in operation, the piston and piston rod therewithin are of course undergoing rapid acceleration and deceleration as the piston reciprocates. The tool or other load that is attached to the tool plate of the cylinder undergoes the same acceleration and deceleration, as does the fluid within the cylinder as well.

Thus, the moving mass that must be stopped at the end of each piston stroke includes the weight of the piston, the piston rod, the load being moved and the fluid in the cylinder. In an uncushioned cylinder, the kinetic energy of this moving mass is abruptly changed into heat energy as the mass stops at the end of a stroke. In addition to heat, the energy conversion process produces noise and vibration. In a cushioned cylinder, means are provided to gradually decelerate the mass as the piston stroke nears its end, thereby reducing noise and vibration. Perhaps more importantly, a cushioned cylinder requires less maintenance and has a longer working life.

One well known way of cushioning a piston is to mount a cushion spear thereon and to provide a cushion cavity formed in the cylinder head that receives the spear. In a singleacting piston, the spear is mounted on the leading face of the piston in axial alignment with the piston's axis of reciprocation. The cushion cavity is formed in the cap end of the cylinder and is cooperatively aligned. Typically, an adjustable needle valve controls air flow into and out of the cushion cavity to thereby regulate the amount of cushioning provided. For example, with the needle valve wide open, the air in the cavity can escape quickly and the cushioning effect is minimized; conversely, with the needle valve advanced, the air in the cushion cavity is constrained to exit said cavity slowly as the spear enters therein, thereby increasing the cushioning effect. Significantly, such needle valve adjustment is the only heretofore known way to adjust the cushioning effect.

A check valve is also typically provided to allow quick start up when the piston reverses its direction of travel and the spear exits the cushion cavity.

In double acting cylinders, a similar spear, called a spud, is mounted to the opposite face of the piston as well, and a mating cushion cavity is formed in the head end of the cylinder; a similar needle valve and check valve arrangement is also provided at said head end. The head end of the cylinder (the end that receives the piston rod) usually has a larger cushion cavity than the cap end of the cylinder, but the cushioning principle is the same at both ends of the cylinder.

A braking means that floats inside a ram to cushion or brake the end of each stroke of the ram is shown in U.S. Pat. No. 3,824,895, to Martin. A plurality of gauged orifices that progressively control the braking of a piston is shown in U.S. Pat. No. 3,998,132 to Rasigade.

Since the above-described conventional cushioning does reduce noise and vibration and extends the working life of the cushioned cylinder, at least to some extent, most inventors have concluded that the art of cylinder cushioning has completed most of its development, and that only minor refinements remain to be discovered.

However, there art numerous limitations of the known cushioning means. A typical spear or spud extends only three-fourths of an inch from the piston, and the matching cushion cavities are therefore of the same general dimension. Thus, deceleration occurs only during the last three-fourths inch of piston travel. Studies have shown that the known cushioning means cushions only the moving mass of the piston and piston rod itself; the load and the mass of the fluid in the cylinder are essentially uncushioned. Thus, there is a noticeable reduction of noise, vibration and wear in cushioned cylinders when compared with uncushioned cylinders, but the noise, vibration and wear are still substantial.

One obvious way to increase the cushioning effect is to lengthen the axial extent of the spear and spud and hence that of the respective associated cushion cavities, but this solution has never been accepted because it detracts from the length of the piston stroke in a cylinder of the same size or it unduly lengthens the length of the cylinder.

The prior art, taken as a whole, neither teaches nor suggests how this seemingly intractable limitation could be overcome.

DISCLOSURE OF INVENTION

The present invention revolutionizes the art by eschewing altogether the use of spears that are mounted on one or both sides of a piston. The world's first floating spear is disclosed herein.

An axially extending central bore is formed in the piston and a spear is slidably disposed therewithin. Thus, instead of two separate spears of limited axial extent being fixedly secured to opposite faces of a piston, a single spear of any preselected length extends through the piston and the opposite ends of the spear are received within their respective cushion cavities. Importantly, even though the novel spear is greatly elongated in relation to the three-quarter inch spears and spuds heretofore known, the depth of the cushion cavities is not any greater than that of prior art cavities, and may even be less. Deceleration can therefore occur during a longer period of time. Importantly, the moving mass of the tool or load as well as that of the cylinder's fluid can be cushioned, thereby dramatically reducing noise and vibration and significantly increasing the working lifetime of the cylinder.

Whereas the non-floating spears of the prior art are substantially fully received within their associated cushion cavities at the end or a piston stroke, and thus require a check valve to allow quick break away of the spear from its cavity, the novel floating spear is only slightly received within its associated cushion cavity and no check valve is required to provide free break away.

This elimination of the check valve eliminates the manufacturing cost associated with said check valve, but perhaps even more importantly, eliminates the down time caused by a failed check valve. The elimination of the check valve is made possible by the provision of the floating spear itself. Since the floating spear has less mass than its associated piston, when the cylinder is actuated to commence a return piston stroke, the spear will begin its reverse stroke slightly before the piston does. For reasons to be disclosed hereinafter, the spear need enter the cushion cavity to a very small extent. Thus, as soon as the spear begins its reverse stroke, the actuating fluid will flow past the retainer ring that limits the travel of the spear into its cushion cavity, and thus said fluid gains access to the entire face of the piston and drives it through its return stroke. The same arrangement is provided at the head end of the cylinder where the spud also has a retainer ring that limits the depth of its insertion into its associated cavity. Thus, the ability of the spear to move independently of the piston due to its floating engagement therewith and the lesser mass of the spear and its limited insertion into its associated cushion cavity all unite to provide a cylinder having free break away in the absence of a check valve.

Moreover, the space between the piston and the respective end caps becomes a part of the cushion cavity due to a highly novel modification to the already novel spear. Specifically, a plurality of diametrically or radially extending bore means, hereinafter called stages, are formed in opposite ends of the floating spear, and an axially-extending blind bore is formed in each end of the spear as well, said stages and said axially extending blind bores being in open communication with each other.

Thus, once the spear or spud has seated in its associated cushion cavity, air in the space between the piston and the cylinder cap end or head end is constrained to flow into the stages and from said stages into the axially extending bores and from said bores into the cushion cavities and into the atmosphere through the needle valves or other exit ports if no needle valves are provided. As the piston approaches the cushion cavity, the stages are gradually closed off by said piston, thereby further increasing the cushioning effect.

Advantageously, the length of the spear, the diameter and length of the blind bores and the diameter, number and spacing of the stages is fully selected by the designer. This makes the spear programmable.

For example, suppose a user of fluid powered cylinders has an application that calls for a linear deceleration. The stages will, in that situation, be positioned at equidistantly spaced intervals. Where a relatively prolonged deceleration is desired, the spear and axial bores formed therein would be elongate, and where a relatively abrupt deceleration were desired, the spear and axial bores formed therein would be relatively truncate.

Moreover, instead of controlling deceleration only by spacing the stages at preselected regular or irregular intervals, the diameter and quantity of said stages can also be selected to provide the desired performance. Thus, the length and diameter of the axially extending bores is selected depending upon the requirements of the cylinder use, as are the spacing, number and diameter of the diametrically extending bores.

The stages can also be eliminated; in that situation, the needle valve can be relied upon to regulate the amount of cushioning provided. In most applications, the number, diameter and spacing of the diametrically extending bores will be relied upon to determine the amount of cushioning provided, with the needle valve being employed as a fine tuning means. The inventive novel spear also performs well even if no needle valve is used.

The length of the spear itself may also be varied by the designer, as mentioned above. As piston velocity and the mass of the load increase, the length of the spear is increased. The length of the blind axial bores is also lengthened with increased velocity and load, as is the number of stages.

It is therefore understood that the primary object of this invention is to pioneer the art of floating spears as a cushioning means for cylinders in fluid power systems.

Another very important object is to provide a floating spear that is programmable so that it may be used in a wide variety of applications.

Still another object is to provide a fluid-actuated cylinder having no check valves yet having free spear cushion break away.

These and other important objects, features, and advantages of the invention will become apparent as this description proceeds.

The invention accordingly comprises the features of construction, combination of elements and arrangements of parts that will be exemplified in the construction set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

BEST MODES FOR CARRYING OUT OF THE INVENTION

Figure 1:
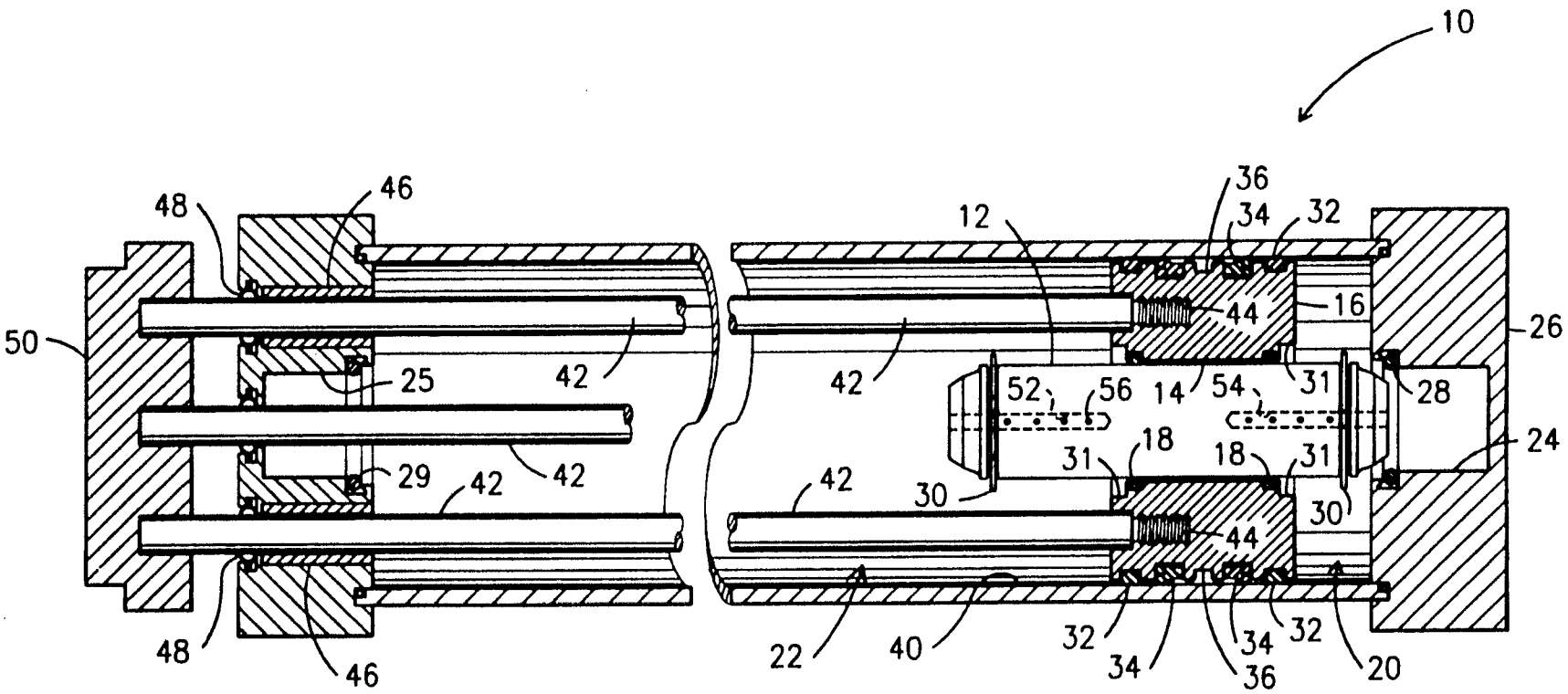
FIG. 1 is a longitudinal sectional view of a cylinder equipped with the novel spear.

Referring now to FIG. 1, it will there be seen that an exemplary embodiment of the invention is denoted as a whole by the reference numeral 10.

The novel floating spear is denoted 12; it is axially received within central bore 14 formed in piston 16. Note that the predetermined length or longitudinal extent of the spear is greater than the predetermined length or longitudinal extent of the piston so that a first end of the spear extends axially of a first face of the piston and a second end of the spear extends axially of a second face of the piston. Axially spaced O rings, collectively denoted 18, perform the function of sealing end chamber 20 from head chamber 22.

Cushion cavity 24 is formed as shown in end cap 26 and another O ring 28 is positioned in an annular groove near the open end of said cavity 24. Spear 12 sealingly engages O ring 28 when the spear completes its stroke, i.e., before the piston completes its stroke. Retainer ring 30 limits the travel of the spear into the cushion cavity, because the diameter of ring 30 is greater than the diameter of the opening of cavity 24. Note that the extent of the spear or spud that enters into its associated cushion cavity is nominal. This is because the cushioning effect is provided primarily by the combined effect of the floating spear, the stages and the blind axial bores, i.e., the novel apparatus does not rely upon the full introduction of a rigid spear into a cushion cavity. Air trapped within the cylinder, once spear 12 seats against 0 ring 28, must exit the cylinder through fluid passageways formed in the spear, as more fully set forth hereinafter.

Annular counterbores 31, 31 are formed in opposite faces of piston 16 as shown. These counterbores accommodate their associated retainer rings 30, 30 when the piston reaches the end of its stroke as will be more fully set forth hereinafter. This feature provides free break away of the piston when it changes its stroke direction, in the absence of a check valve, as will be seen.

Plural annular grooves are formed in piston 16 to accommodate wear bands 32, U-cup seals 34, and an optional magnetic band 36, not expressly shown. These bands and seals enable low-friction reciprocation of piston 16 relative to cylinder walls 40.

Plural piston rods, circumferentially spaced and collectively denoted 42, screw-threadedly engage piston 16 as at 44. Note that the central disposition of spear 12 relative to piston 16 eliminates the use of the novel floating spear in cylinders having a single, centrally disposed piston rod. The cylinder of FIG. 1 is a tri-rod cylinder, but the invention has equal utility in connection with any cylinder design having at least two rods or more.

The opposite ends of each piston rod 42 are slidably disposed in head end 44 and suitable bushings, collectively denoted 46, are provided to facilitate reciprocation of said rods. Double lip wiper seals 48 are provided near the end of head cap 44. The end of each piston rod is suitably affixed to a tooling plate 50; the load or tool, not shown, is affixed to said plate 50.

A second cushion cavity 25 having O ring 29 is formed in said head cap 44; said second cushion cavity receives the second end of the spear when piston 16 is positioned remote from end cap 26.

Axial bores 52, 54 are formed in opposite ends of spear 12.

More particularly, as shown in FIG. 1, bore 54 is formed in a first end of said spear and bore 52 is formed in a second end of said spear. It is important to appreciate that the longitudinal extent of each blind bore 52, 54 may be varied independently of the other bore, and that the respective diameters of each bore can also be varied. Thus, even though bores 52 and 54 appear to have a common diameter in FIG. 1, they may have widely differing diameters. Note that the axial extent of bore 52 is greater than that of bore 54. Moreover, as mentioned earlier, the length of the spear 12 itself is variable at the selection of the machine designer.

Plural diametrically or radially extending bores, collectively denoted 56, are formed in spear 12. Each of these bores, or stages, provides fluid communication between the air trapped inside the cylinder and the interior of its associated axial bore. Stages 56 may be equidistantly spaced with respect to one another, or grouped in any other preselected regular or irregular spacing. Moreover, the respective diameters and quantity of the stages may be varied as well to further program the behavior of the spear in accordance with a user's needs.

Figure 2:
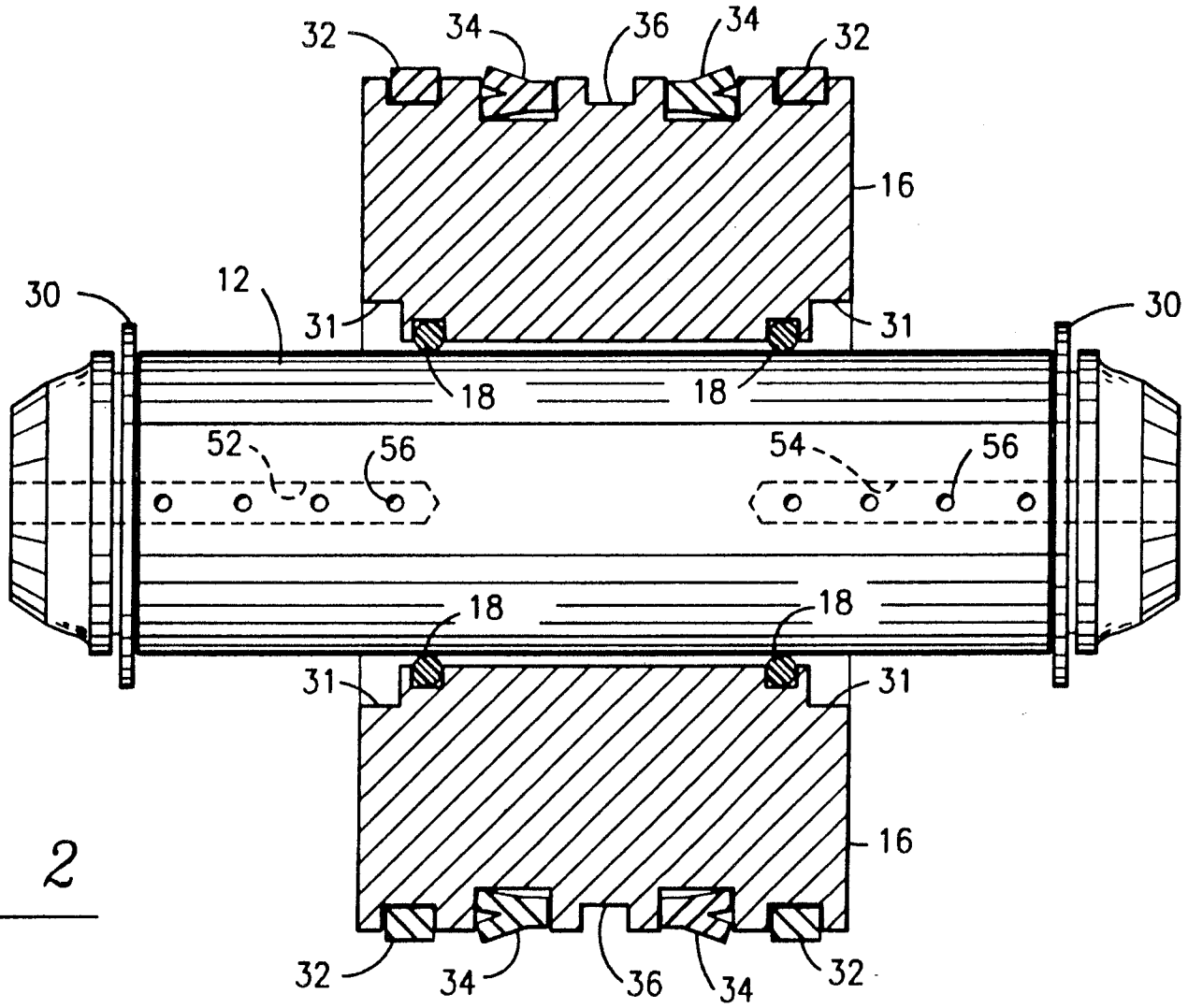
FIG. 2 is a side elevational view of the spear shown in FIG. 1.
Figure 3:
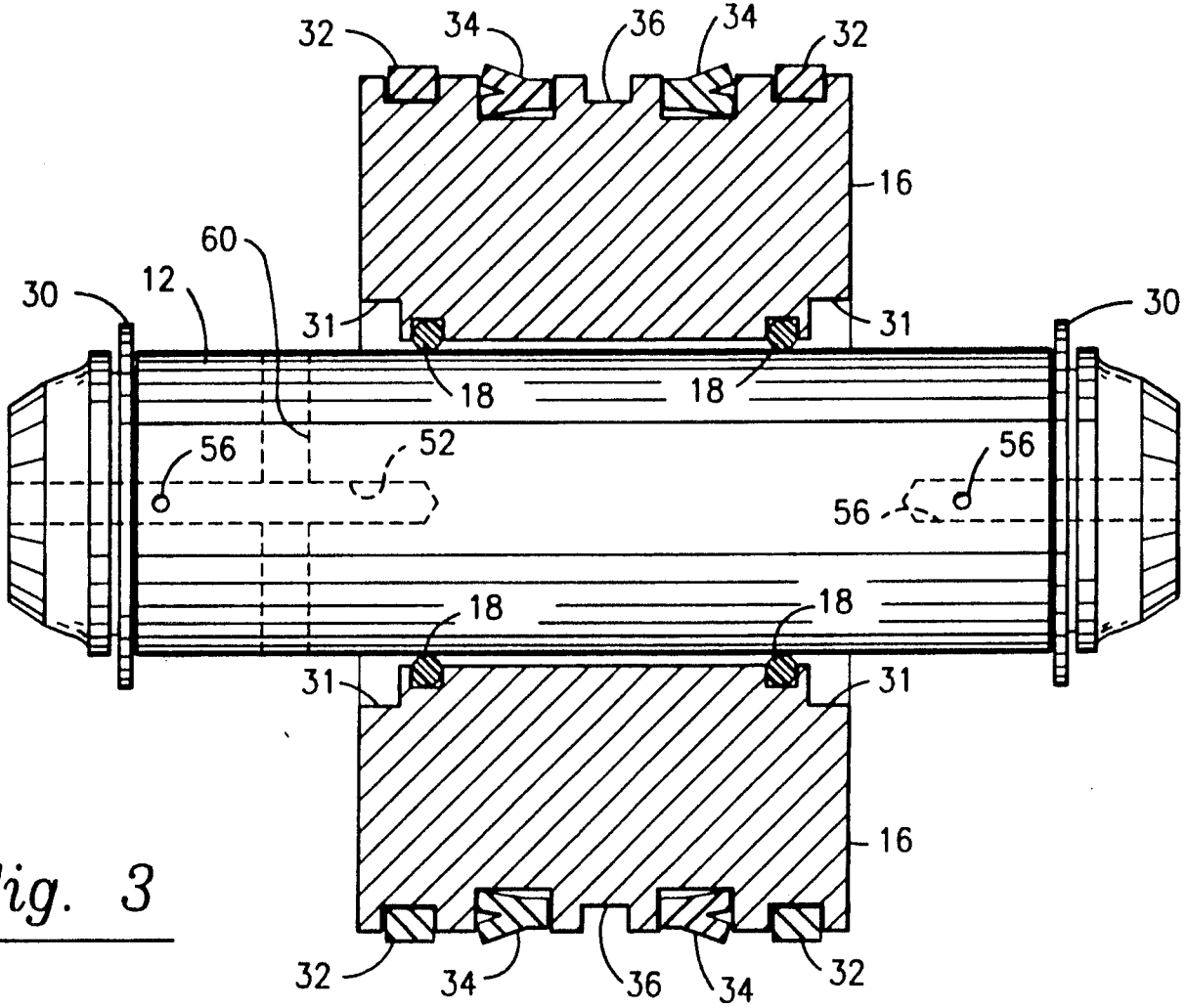
FIG. 3 is a side elevational view of another spear made in accordance with the teachings of this invention.

For example, note in FIG. 3 that only one diametrically extending bore 56 is formed in each end of spear 12, and that the respective positions of each bore is different with respect to its associated blind axial bore. This arrangements of parts programs the spear to cushion the piston in a preselected manner that is different from the cushioning profile provided by the arrangement of FIG. 2.

Transverse bore 60, shown in FIG. 3, is provided in variable speed applications only, i.e., in applications where a first piston stroke is fully cushioned and the reverse or return stroke thereof is cushioned to a lesser extent. The large diameter of variable speed bore 60 allows fluid otherwise constrained to enter axial bore 52 through stages 56 to enter said bore 52 through said transverse bore 60, thereby encountering little or no resistance until transverse bore 60 is covered by piston 16. Since there is essentially no load on the piston during its return stroke in a variable speed application, the only cushioning needed is provided by the lone cushioning stage 56 adjacent head end retainer ring 30. The transverse bore 60 will be shut off by piston 16 at the end of the stroke, as aforesaid, i.e., said bore 60 will be between seals 18, 18, thereby constraining air in the space exterior to the spear to enter axial bore 52 through cushioning stage 56 to provide the small cushioning effect needed for such return stroke.

In a preferred embodiment of the invention, two intersecting transverse bores 60 are provided at right angles to one another.

Figure 4:
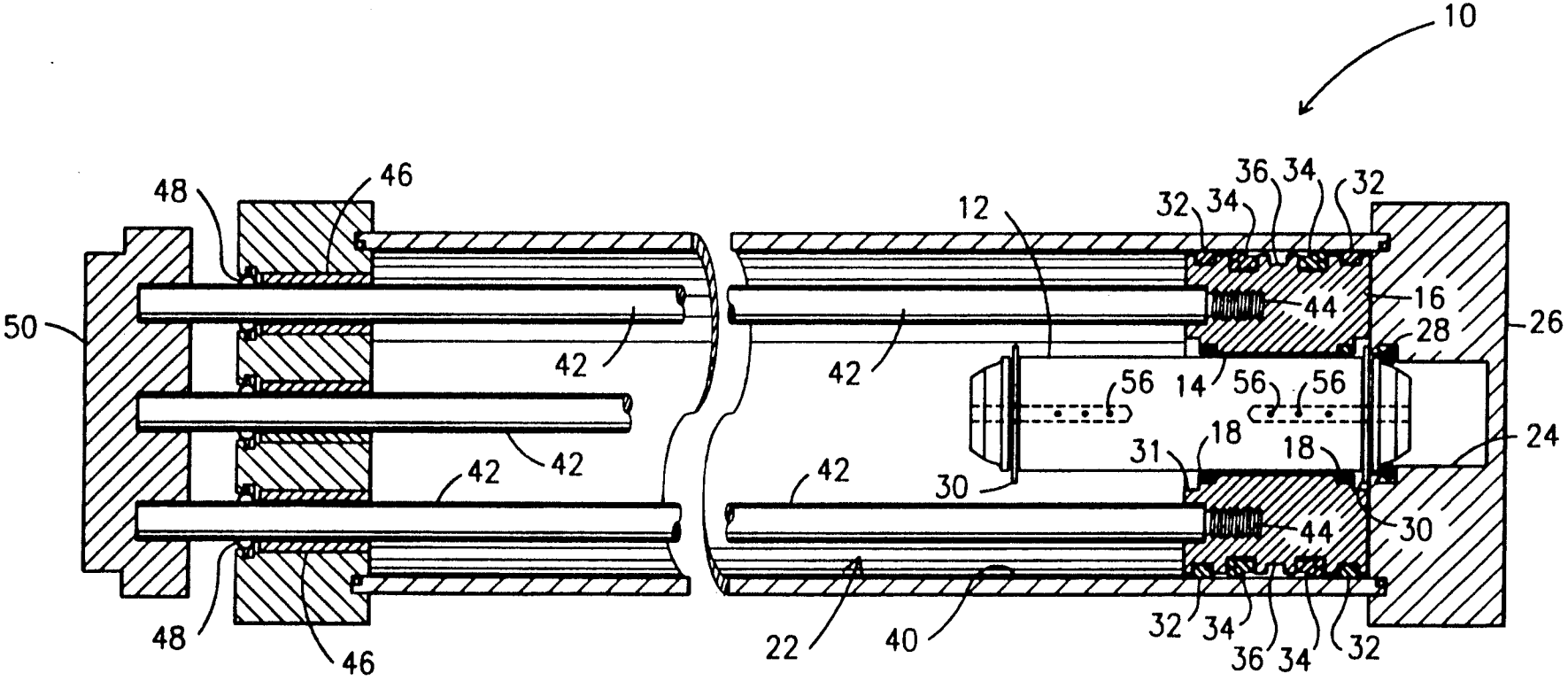
FIG. 4 is a view similar to FIG. 1, but showing the piston at the end of its piston stroke and the spear fully seated.

FIG. 4 shows how counterbore 31 accommodates retainer ring 30 when the piston has reached the end of a stroke. Note that the spear is fully seated on annular seal 28. Note also that said spear is fully seated thusly prior to the piston 16 reaching the end of its stroke, thereby insuring that air attempting to exit cushion cavity 24 must first flow through stages 56 and axial bore 54.

Figure 5:
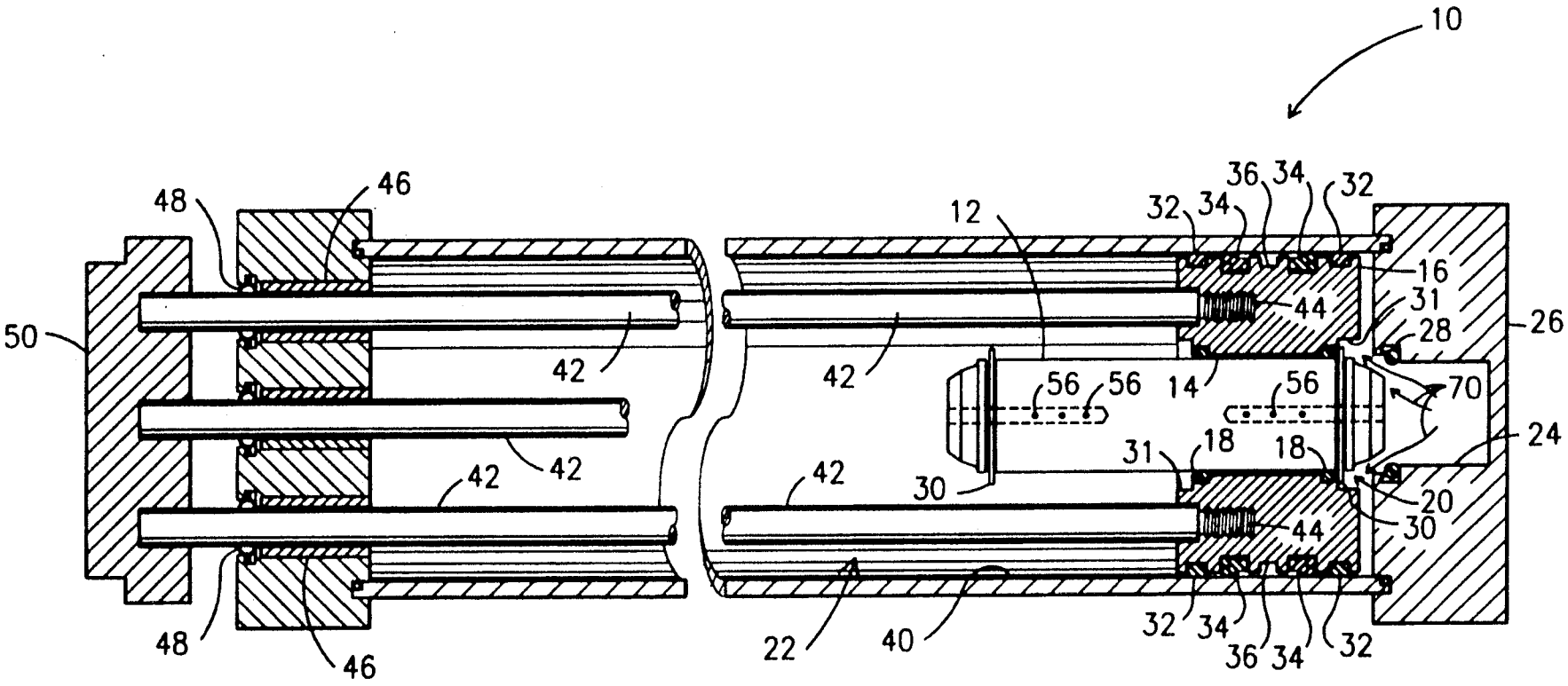
FIG. 5 is a view similar to FIG. 4, but showing the spear unseated from the cushion cavity.

FIG. 5 shows how the actuating fluid entering cushion cavity 24 causes the spear 12 to begin reverse travel at least momentarily before piston 16. FIG. 5 also shows how counterbore 31 accommodates retainer ring 30 when the spear begins its return stroke. The reference arrows 70 indicate how the actuating fluid can flow past the now unseated retainer ring 30 into cavity 20 so that said fluid can bear against the face of piston 16 and cause it to begin its reverse stroke. No check valve is provided nor needed to allow this free break away.

Note that the embodiment of FIGS. 4 and 5 is provided with only one cushion cavity, i.e., no cushion cavity is provided in the head cap 44 of this particular embodiment.

With so many variables being available to the machine designer, the novel floating spear can meet the needs of any application. Just as importantly, the cushioning effect of the novel spear is greatly enhanced over that of the rigid prior art spears, without increasing the length of the cylinder and without reducing the working length of the piston stroke.

It should be understood that the stages 56 and the blind bores 54 need not be formed exactly as described. For example, their function is to provide fluid passageways through which air trapped in the cylinder may flow in route to the cushion cavity and hence to the atmosphere through a needle valve or other escape port. Thus, the stages need not be disposed in diametrically extending relation as shown in the drawings, as long as they intersect the blind bores. Nor do the stages need to intersect the blind bores at right angles, it being understood that any angle of intersection is within the scope of this invention. The blind bores and the stages need not be straight and the blind bores may also be offset from the axis of the spear.

This invention is clearly new and useful. Moreover, it was not obvious to those of ordinary skill in the art at the time it was made, in view of the prior art when considered as a whole.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. In a fluid-actuated cylinder, comprising:

a reciprocably mounted piston having a predetermined longitudinal extent;

an axially extending bore formed through said piston;

a spear slidably mounted in said bore;

said spear having a predetermined length greater than the predetermined length of said piston;

a first end of said spear extending axially beyond a first face of said piston;

a second end of said spear extending axially beyond a second face of said piston.

said cylinder including a head end and a cap end;

a first cushion cavity, formed in said cap end, adapted to at least partially receive said first end of said spear; and a second cushion cavity, formed in said head end, adapted to at least partially receive said second end of said spear;

whereby said spear cushions said piston as it reciprocates between said cap end and said head end.

2. The cylinder of claim 1, wherein said bore is formed in said piston coincident with a central axis thereof.

3. The cylinder of claim 2, further comprising a first axially extending blind bore formed in a first end of said spear, said first blind bore having a predetermined axial extent and a predetermined diameter.

4. The cylinder of claim 3, further comprising a first diametrically extending bore formed in said first end of said spear, said diametrically extending bore being in open communication with said axially extending blind bore, and said diametrically extending bore having a predetermined diameter.

5. The cylinder of claim 3, further comprising a second axially extending blind bore formed in a second end of said spear, said second blind bore having a predetermined axial extent and a predetermined diameter.

6. The cylinder of claim 5, further comprising a second diametrically extending bore formed in said second end of said spear, said second diametrically extending bore being in open communication with said second axially extending blind bore, and said second diametrically extending bore having a predetermined diameter.

7. The cylinder of claim 6, further comprising a retainer ring mounted to said spear adjacent its first and second ends to limit the amount of travel of each end of said spear into its associated cushion cavity.

8. The cylinder of claim 7, further comprising a retainer ring-receiving counterbore formed in each side of said piston at its radially innermost end to accommodate said retainer rings at the beginning of a return stroke of said spear;

whereby said spear is free to begin its return stroke prior to the return stroke of said piston so that fluid may bear against a piston face to achieve free break away.

9. The cylinder of claim 8, further comprising at least one transverse bore formed in said spear, said at least one transverse bore being in open communication with an associated blind bore and said at least one transverse bore having a diameter sufficiently large to freely admit air trapped in said cylinder into said blind bore and hence into an associated cushion cavity, to thereby substantially eliminate the cushioning effect.

10. A fluid-actuated cylinder having a head cap and an end cap and a cushion cavity formed in said end cap, comprising:

a slidably mounted piston having a central bore formed therein;

said piston having a predetermined longitudinal extent;

a spear member being slidably mounted in said bore;

said spear member having a first end adapted to engage said end cap cushion cavity;

at least one fluid passageway being formed in said spear member so that air trapped within said cylinder is constrained to exit said cylinder through said at least one fluid passageway as said piston moves within said cylinder;

said spear member having a predetermined longitudinal extent greater than the longitudinal extent of said piston;

said first end of said spear member extending axially of a first face of said piston; and a second end of said spear member extending axially of a second face of said piston;

whereby said piston is cushioned as it approaches said end cap.

11. The cylinder of claim 10, further comprising a plurality of fluid passageways formed in said spear member, each of said fluid passageways providing fluid communication between air in said cushion cavity and air trapped within said cylinder when said spear is seated in said cushion cavity.

12. The cylinder of claim 11, wherein each of said fluid passageways includes a blind bore formed in said spear and at least one radially extending bore in open fluid communication therewith.

13. The cylinder of claim 12, wherein said radially extending bore extends diametrically through said spear member and wherein said blind bore is axially formed in said spear member.

14. A fluid-actuated cylinder, comprising:

a reciprocably mounted piston having a predetermined longitudinal extent;

an axially extending bore formed through said piston;

a spear slidably mounted in said bore;

said bore formed in said piston coincident with a central axis thereof;

said spear having a predetermined length greater than the predetermined length of said piston;

a first end of said spear extending axially beyond a first face of said piston;

said cylinder having a head end and a cap end;

a first cushion cavity, formed in said cap end, adapted to at least partially receive said first end of said spear;

a second cushion cavity, formed in said head end, adapted to at least partially receive said second end of said spear;

a first axially extending blind bore formed in said first end of said spear, said first blind bore having a predetermined axial extent and a predetermined diameter;

a first diametrically extending bore, having a predetermined diameter, formed in said first end of said spear, said diametrically extending bore being in open communication with said axially extending blind bore; and a second axially extending blind bore formed in said second end of said spear, said second blind bore having a predetermined axial extent and a predetermined diameter.

15. The cylinder of claim 14, further comprising a second diametrically extending bore formed in said second end of said spear, said second diametrically extending bore being in open communication with said second axially extending blind bore, and said second diametrically extending bore having a predetermined diameter.

16. The cylinder of claim 14, further comprising retainer rings mounted to said spear adjacent its first and second ends to limit the amount of travel of each end of said spear into its associated cushion cavity.

17. The cylinder of claim 16, further comprising a retainer ring-receiving counterbore formed in each side of said piston at its radially innermost end to accommodate said retainer rings at the beginning of a return stroke of said spear;

whereby said spear is free to begin its return stroke prior to the return stoke of said piston so that fluid may bear against a piston face to achieve free break away.

18. The cylinder of claim 17, further comprising at least one transverse bore formed in said spear, said at least one transverse bore being in open communication with an associated blind bore and said at least one transverse bore having a diameter sufficiently large to freely admit air trapped in said cylinder into said blind bore and hence into an associated cushion cavity, to thereby substantially eliminate the cushioning effect.

* * * * *